United States Patent [19]

Ginter

[11] Patent Number: 4,662,121

[45] Date of Patent: May 5, 1987

[54] BACKING BLOCK FOR PROFILE SANDERS

[75] Inventor: Richard E. Ginter, Arrington, Va.

[73] Assignee: Armstrong World Industries, Inc., Lancaster, Pa.

[21] Appl. No.: 348,031

[22] Filed: Feb. 11, 1982

[51] Int. Cl.[4] ..... B24B 21/18

[52] U.S. Cl. ..... 51/141; 51/140; 51/266

[58] Field of Search ..... 51/141, 135, 137, 140, 51/266, 391

[56] References Cited

U.S. PATENT DOCUMENTS

| | | | |
|---|---|---|---|
| 2,199,069 | 4/1940 | Fowler | 51/141 |
| 2,527,554 | 10/1950 | Kimball | 51/141 X |
| 2,717,422 | 9/1955 | Rowe et al. | 51/141 X |
| 3,170,272 | 2/1965 | Burnham | 51/141 |
| 4,204,371 | 5/1980 | Horwitz | 51/141 |

FOREIGN PATENT DOCUMENTS

| | | | |
|---|---|---|---|
| 1045634 | 12/1958 | Fed. Rep. of Germany | 51/141 |

*Primary Examiner*—Robert P. Olszewski

[57] ABSTRACT

Disclosed is a shaped backing block for abrasive-coated belts of profile sanding devices. The shaped block having improved wear and heat dissipation characteristics comprises a block of aluminum silicate cut to the desired size and having one face thereof machined to the desired contour. The contoured face of the block is sanded and polished and holes or passageways extending parallel to the face of the block are provided through the body thereof to dissipate heat. The shaped blocks are then hardened by firing at a very high temperature.

2 Claims, 3 Drawing Figures

FIG. 2
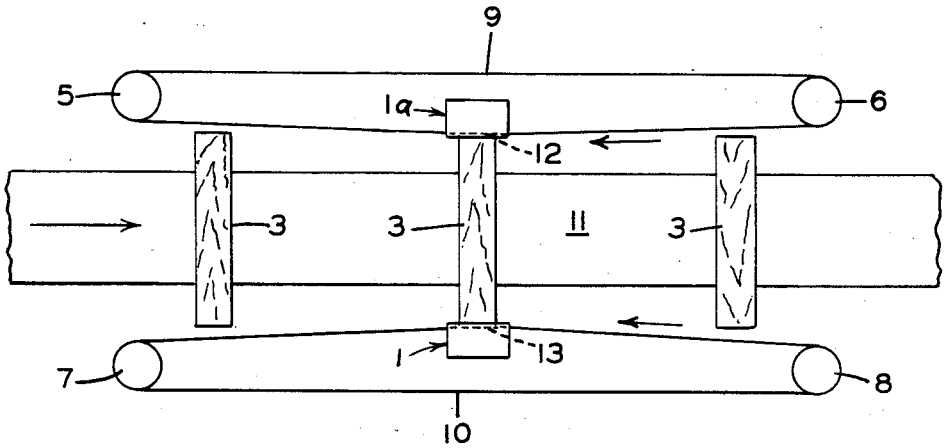
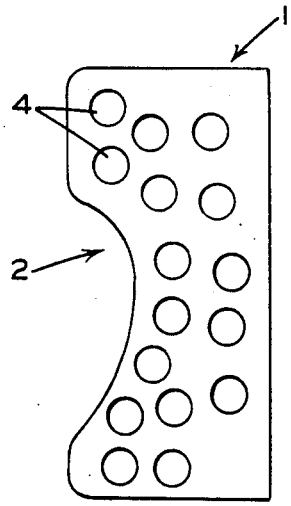
FIG. 1
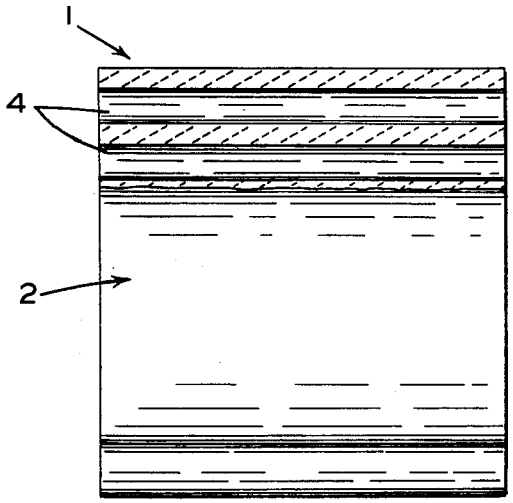
FIG. 3

BACKING BLOCK FOR PROFILE SANDERS

BACKGROUND OF THE INVENTION

1. Field of the Invention

This invention relates generally to backing blocks for abrasive coated belts used in traveling-belt sanding machines. More particularly, the invention relates to a shaped backing block having improved wear and heat dissipation characteristics and a superior smoothness of the belt contacting portion thereof.

2. Description of the Prior Art

It has been known in the past to use shaped backing blocks to press an abrasive-coated traveling belt against articles of wood in the making of moldings, furniture, and the like. When a backing block is pressed against the back of a sanding belt, which may be moving anywhere from 2500 to 5000 ft/min., considerable heat is produced by surface friction between them. This friction and the heat generated thereby causes deterioration of the block, expansion thereof (depending on the block material), uneven wear, and shortens the life of the belt. Additionally, the dusty environment created by the sanding operation adds to the wear on the backing block and the back of the belt and if steel or any iron alloy backing blocks were used a fire hazard would exist because of the possibility of sparks which might ignite the dust particles.

Heretofore, backing blocks have been formed according to standard practice either from a block of solid material such as wood, babbit-type material, plastic, glass, or a relatively more resilient material such as hard rubber, or hard block felt. The blocks were shaped by machining or otherwise forming on one face of the block a reverse of the profile of the piece to be sanded. This involved painstaking and laborious shaping and fitting to obtain satisfactory accuracy.

Due to the rapid wearing and deterioration of the blocks formed of the materials heretofore employed and, since a different backing block having a particular profile must be provided for each different shaped piece to be sanded, the problem of forming and maintaining an adequate supply of these backing blocks has been burdensome and expensive, especially in continuous sanding operations where relatively heavy sanding pressures are used.

U.S. Pat. No. 2,717,422 relates to a method and means for forming a sanding block. The block is characterized by a pressure face liner formed of a dimensionally stable plastic material and bearing on its face an impression of the wood molding profile to be sanded.

U.S. Pat. No. 2,624,160 relates to a lubricating means for platens or backing plates to reduce friction between the backing plates and the back of a traveling belt abrasive grinding machines. The lubricating means comprises a solid lubricant held in a pattern of grooves formed in the face of the backing plate.

U.S. Pat. No. 2,633,679 relates to a facing sheet affixed to a shaped block for pressing a traveling abrasive-coated belt against a work piece. Glass beads are adhesively affixed to the facing sheet to form a non-continuous pressing surface, thus reducing materially the frictional drag between the pressing member and the back of the belt.

U.S. Pat. No. 3,685,219 relates to a contour-abrasion means and method wherein a contoured back-up member for the adhesive-coated belt is provided with holes extending inwardly from its face to an air-supply channel. Air fed through the holes produces a thin air cushion for the belt to ride on.

U.S. Pat. No. 2,431,822 relates to an abrasive belt polishing machine which utilizes a contoured cylindrical roller to engage the side of a traveling abrasive-coated belt to press it into engagement with the surface of the work piece.

U.S. Pat. No. 2,934,279 relates to the production of ground wood pulp wherein a back-up plate is used to press an abrasive-coated traveling belt against a log or billet. It is stated in this patent that the heat generated by friction between the face of the pressure plate and the back of the belt may be dissipated by the introduction of water therebetween through small holes or pores in the plate.

It is apparent that the prior art disclosures have not provided a backing plate for pressing a traveling abrasive-coated belt against a work piece wherein, the backing plate would have a highly polished wear surface and good heat-dissipating characteristics, thus prolonging the life of the belt and the plate; a low rate of expansion and wear to maintain the shape of the sanded parts and to reduce dramatically the cost, time, effort, and inventory required to maintain an adequate supply of backing plates.

SUMMARY OF THE INVENTION

This invention relates to a backing block adapted for use in profile sanders to hold a traveling abrasive-coated belt in engagement with the work piece being sanded. The block comprises a non-porous, heat-hardened, size and shape retaining, wear and heat-resistant block of aluminum silicate material having a highly polished face which is shaped to conform to the shape of the work piece portion which is being sanded. A plurality of holes which extend completely through the body of the block are provided in back of the face portion thhereof for heat-dissipation purposes.

BRIEF DESCRIPTION OF THE DRAWING

FIG. 1, is an end view showing the backing block of this invention; and

FIG. 2, is a top diagrammatic plan view illustrating the the block in a traveling-belt sanding apparatus.

FIG. 3, is a front view, partially broken away, of the block of FIG. 1.

DESCRIPTION OF THE PREFERRED EMBODIMENT

Referring to the drawings, there is shown the backing block 1 which may be generally rectangularly shaped. However, other overall shapes could obviously be used if this were desirable. As shown, the block 1 has a face portion 2 which is shaped according to whatever configuration is required to have it conform to the contour of the work piece portion 3 which is being sanded. A plurality of holes 4 are provided through the body of the block in back of the face portion 2. The holes function as a heat-dissipating means and are formed as shown, running from end-to-end of the block, but of course, may be in other directions if desired and perform the same function.

As shown in FIG. 2, a conventional traveling belt sanding machine may comprise spaced pulleys 5 and 6, 7 and 8, on which abrasive-coated belts 9 and 10 are mounted. At least one of each pair of pulleys is driven by conventional drive means (not shown). In the sanding apparatus illustrated in FIG. 1, the work pieces 3 are carried by conveyor 11 to the points 12 and 13 where the sanding belts 9 and 10 are pressed into contact therewith before passing on through the apparatus for further processing.

The flexible sanding belts 9 and 10 may be of conventional construction, such as an appropriate fabric of adequate tensile strength and flexibility to resist both the sanding action against the work piece 3, the frictional action against the backing blocks 1 and 1*a*, and to conform to the contours of the work piece and shaped backing blocks 1 and 1*a* at the points where they are held in engagement with the work piece 3 by the backing blocks 1 and 1*a*.

The backing block 1 of this invention comprises a shaped block of highly refractory aluminum silicate material. The belt-contacting face 2 of the block 1 is machined or formed to conform to the contour of the work piece 3 to be sanded and is highly polished, and a plurality of holes 4 which extend completely through the body of the block 1 are formed therein at a location behind the shaped belt-contacting face portion 2 to aid in the dissipation of heat from the block. The block so formed is then fired or heated at a high temperature to form an extremely hard, non-porous, wear and heat-resistant block having a low rate of expansion.

As previously indicated herein, the high wear and heat-resistance of the block 1 is important, in that it lasts much longer than backing blocks previously used, and by retaining the original accuracy of the contour of its face portion much longer, the desired shape and dimensions of the sanded portions of the work piece are assured for longer periods during the sanding operation. Obviously, the low rate of expansion of the block also further assures more accurate sanding of the contour of the work piece. Since, due to the hardness and highly polished surface of the belt-contact portion 2 of the block, and its heat dissipating capabilities, there is also an unexpected increase in belt life over that experienced when prior back-blocks were used, due to the decreased temperatures. The temperature range experienced when using the old style babbit blocks was about 180°-200° F. The temperature range with the aluminum silicate blocks was about 75°-90° F.

The backing block 1 of this invention is a block of mullite having a shaped and highly polished belt contacting face portion 2. The mullite is formed from any of three naturally occurring aluminum silicates. These three minerals are commonly called: kyanite, sillimanite, and andalusite, each having the chemical formula $Al_2O_3.SiO_2$. When these minerals are heated to the proper temperatures (about 1550° C.-1625° C.) mullite ($3Al_2O_3.2SiO_2$) is formed.

Any conventional means may be used to press the backing block against the back of the sanding belt to force it into engagement with the work piece to be sanded or, as illustrated in FIG. 1, the backing blocks 1 and 1*a* may be in a fixed position so-located that the work pieces 3 carried by the conveyor 11 are automatically brought into engagement with the sanding belt as it passes the points 12 and 13 where the belts 9 and 10 pass over the backing blocks 1 and 1*a*.

In view of the foregoing, it will be apparent that, by this invention there is provided a unique and superior backing block for sanding machines which may be easily formed to the correct profile, and highly polished before it is hardened. After hardening the block, in use, results in increased belt life, greatly reduced need for replacement due to increased wear properties, greater maintenance of accuracy of sanded parts due to its lower rate of wear and expansion, lower running temperatures made possible by the highly polished hard belt-contacting surface and heat dissipating feature of the block.

What is claimed is:

1. In a machine for sanding shaped work pieces, the combination of at least one pair of spaced pulleys, flexible abrasive-coated belt means mounted on said pulleys for travel thereover, backing means adapted to press against the back of said flexible traveling belt means to urge the abrasive-coated side thereof into contact with and shape the belt to the contour of the work piece portion to be sanded, said backing means comprising a block of non-porous, heat-hardened aluminum silicate having a highly polished, belt-contacting face portion shaped to conform to the shape of the work piece portion to be sanded, said backing block also having hole means extending completely therethrough at a location remote from said face portion to dissipate heat from the block.

2. A backing block adapted to be used in profile sanders to force a flexible traveling abrasive-coated belt into engagement with and shape the belt to the contour of a work piece portion to be sanded, said block comprising a block of non-porous, heat-hardened, naturally occurring aluminum silicate, said block further having a highly polished face shaped to conform to the shape of the work piece portion to be sanded, and hole means extending completely through the block in back of the shaped face portion to dissipate heat from the block.

* * * * *